United States Patent [19]

Dorer, Jr. et al.

[11] 4,032,303

[45] June 28, 1977

[54] FUEL COMPOSITIONS CONTAINING ESTERS AND ESTER-TYPE DISPERSANTS

[75] Inventors: Casper John Dorer, Jr., Lyndhurst; Clark Ober Miller, Willoughby Hills, both of Ohio

[73] Assignee: The Lubrizol Corporation, Wickliffe, Ohio

[22] Filed: Oct. 1, 1975

[21] Appl. No.: 618,658

[52] U.S. Cl. ..... 44/70

[51] Int. Cl.[2] ..... C10L 1/18

[58] Field of Search ..... 44/66, 70

[56] References Cited

UNITED STATES PATENTS

| | | | |
|---|---|---|---|
| 3,658,495 | 4/1972 | Dorer, Jr. | 44/66 |
| 3,708,522 | 1/1973 | LeSeur | 44/70 |
| 3,838,052 | 9/1974 | Miller | 44/66 |

*Primary Examiner*—Daniel E. Wyman
*Assistant Examiner*—Mrs. Y. Harris-Smith
*Attorney, Agent, or Firm*—James W. Adams, Jr.; William H. Pittman

[57] ABSTRACT

Improved fuel compositions with decreased tendency to form deposits in the carburetor and on "early fuel evaporation" heating elements, inlet valves and the like contain a normally liquid fuel (usually a hydrocarbon fuel), a carboxylic acid ester which is either (1) an ester of a polyol and a $C_5$–$C_{15}$ monocarboxylic acid or (2) an alkanol ester of a substituted succinic acid, and an oil-soluble, ester-type, nitrogen-free dispersant derived from a polyhydric alcohol and characterized by the presence therein of a substantially saturated aliphatic hydrocarbon-based radical having at least about 30 carbon atoms.

9 Claims, No Drawings

FUEL COMPOSITIONS CONTAINING ESTERS AND ESTER-TYPE DISPERSANTS

INTRODUCTION AND DESCRIPTION OF THE INVENTION

This invention relates to new compositions of matter suitable for use as internal combustion engine fuels. More particularly, it relates to fuel compositions comprising:

a major amount of

A. a normally liquid fuel and, dissolved therein, a minor amount of the combination of:

B. at least one carboxylic acid ester selected from the group consisting of 1. esters of polyols containing at least 3 hydroxy groups and $C_{5-15}$ aliphatic monocarboxylic acids, and
2. esters, containing about 30–80 carbon atoms, of alkanols and alkyl-based succinic or alkenyl-based succinic acids; and C. At least one oil-soluble, nitrogen-free dispersant which is an ester of a polyhydric alcohol having within its molecular structure a substantially saturated aliphatic hydrocarbon-based radical containing at least about 30 carbon atoms.

The development of fuels containing dispersants to promote carburetor cleanliness has been of increasing interest recently. Still more recently, an "early fuel evaporation" system has been developed to aid in the reduction of emissions from engines burning gasoline and similar volatile fuels. The early fuel evaporation system contains an element adapted to heat the air-fuel mixture before its entry into the carburetor, whereby evaporation is well under way by the time the fuel reaches the engine.

Non-volatile constituents of the fuel, such as additives, sometimes form deposits or varnish on inlet valves and on heating elements such as the early fuel evaporation element. Such deposits and varnish impair the efficiency of these elements. It is therefore of interest to provide additive systems which tend to decrease such deposition and varnish formation, while at the same time permitting or encouraging carburetor dispersancy as provided by heretofore known dispersant additives.

A principal object of the present invention, therefore, is to prepare improved fuels.

A further object is to provide fuels having carburetor dispersancy properties comparable to that of the fuels heretofore known, while at the same time inhibiting fouling of and varnish deposition on inlet valves and on heating elements such as the early fuel evaporation heater.

Other objects will in part be obvious and will in part appear hereinafter.

COMPONENT A

Component A in the compositions of this invention is a normally liquid fuel, usually a hydrocarbonaceous petroleum distillate fuel such as aviation or motor gasoline, as defined by ASTM Specification D439-73, or diesel fuel or fuel oil as defined by ASTM Specification D396. Fuels containing non-hydrocarbonaceous materials such as alcohols, ethers, organonitro compounds and the like are also useful as are liquid fuels derived from vegetable or mineral sources such as corn, alfalfa, shale and coal. Particularly preferred is gasoline, that is, a mixture of hydrocarbons having an ASTM boiling point of about 60° C. at the 10% distillation point to about 205° C. at the 90% distillation point.

COMPONENT B

Component B is at least one carboxylic acid ester from one of two classes. The preferred esters are liquid esters, especially those of lubricating viscosity.

The first class of esters useful as component B includes esters of polyols containing at least 3 hydroxy groups and $C_{5-15}$ aliphatic monocarboxylic acids. The polyols are usually those in the $C_{3-15}$ range such as glycerol, trimethylolethane, trimethylolpropane, trimethylolbutane, pentaerythritol, dipentaerythritol and tripentaerythritol, with the pentaerythritols being preferred.

The acids are those of the formula RCOOH, wherein R is an aliphatic hydrocarbon-based radical which is preferably substantially saturated. As used herein, the term "aliphatic hydrocarbon-based radical" denotes an aliphatic radical having a carbon atom directly attached to the remainder of the molecule and having predominantly hydrocarbon character within the context of this invention. "Substantially saturated" means that the radical contains no acetylenic unsaturation and, for radicals containing more than about 20 carbon atoms, at least about 95% of the carbon-to-carbon bonds therein are saturated. For radicals containing about 20 carbon atoms or less, it means the presence of no more than two and usually no more than one olefinic bond. Suitable radicals include the following:

1. Aliphatic radicals (which are preferred).

2. Substituted aliphatic radicals; that is, aliphatic radicals containing non-hydrocarbon substituents which, in the context of this invention, do not alter the predominantly hydrocarbon character of the radical. Those skilled in the art will be aware of suitable substituents; examples are nitro, cyano, $$RO-,\ RO\overset{\overset{O}{\|}}{-},\ ROC\overset{\overset{O}{\|}}{-},\ R'NHC\overset{\overset{O}{\|}}{-},\ RS\overset{\overset{O}{\|}}{-},\ RS\underset{\underset{O}{\|}}{\overset{\overset{O}{\|}}{-}},\ RS-\ \text{and}\ RSS-$$

(R being a hydrocarbon radical and R′being hydrogen or a hydrocarbon radical).

3. Aliphatic hetero radicals; that is, aliphatic radicals which, while predominantly hydrocarbon in character within the context of this invention, contain atoms other than carbon present in a chain otherwise composed of carbon atoms. Suitable hetero atoms will be apparent to those skilled in the art and include, for example, oxygen, sulfur and nitrogen.

In general, no more than about three substituents or hetero atoms, and usually no more than one, will be present for each 10 carbon atoms in the aliphatic hydrocarbon-based radical.

Suitable acids for producing the esters of the first class include valeric, caproic, caprylic, capric, lauric, myristic and pentadecanoic acids, as well as isomers and substituted derivatives thereof. The preferred acids are those in the $C_{5-10}$ range. Especially preferred esters in the first class are the pentaerythritol, dipentaerythritol and tripentaerythritol esters of mixtures of $C_{5-10}$ predominantly straight-chain monocarboxylic acids.

Component B may also be an ester, containing about 30–80 carbon atoms, of an alkanol and a succinic acid containing an alkyl-based or alkenyl-based substituent.

By "alkanol" is meant a saturated aliphatic monohydroxy alcohol such as methanol, ethanol, propanol, butanol, pentanol, hexanol, octanol, decanol, dodecanol, tridecanol, pentadecanol, octadecanol and eicosanol, all isomers thereof being included. The $C_{10-20}$ alkanols are preferred.

The acid portion of the second class of esters useful as component B is derived from a succinic acid having an alkyl-based or alkenyl-based (preferably an alkyl or alkenyl) group which contains about 10–20 carbon atoms. (The terms "alkyl-based" and "alkenyl-based" have meanings similar to "aliphatic hydrocarbon-based" with respect to alkyl and alkenyl radicals, respectively.) Such succinic acids (or their anhydrides) are typically prepared by the reaction of an olefin or a subsituted aliphatic hydrocarbon with maleic acid, fumaric acid or maleic anhydride, according to art-recognized methods. The especially preferred acids are those whose anhydrides are prepared by the alkylation of maleic anhydride with a commercially available mixture of predominantly straight-chain $C_{15-18}$ $\alpha$-olefins.

COMPONENT C

Component C is at least one oil-soluble, nitrogen-free dispersant which is a carboxylic acid ester. Dispersants of this type are known in the art and are disclosed, for example, in the following U.S. patents: 3,325,567, 3,381,022, 3,522,179, 3,533,945, 3,542,678, 3,542,680, 3,579,450, 3,632,510, 3,639,242, 3,697,428, 3,708,522, 3,755,169, 3,787,374, 3,836,469, 3,838,050, 3,838,052, 3,859,318, 3,879,308.

The disclosures in these patents of nitrogen-free ester dispersants are incorporated by reference herein.

The polyhydric alcohol portion of the ester dispersant may be derived from a diol such as ethylene glycol, diethylene glycol, dipropylene glycol, tetramethylene glycol, neopentyl glycol; from a polyol of the type listed hereinabove with respect to component B; or from a partially esterified derivative of a polyhydric alcohol with at least three hydroxy radicals. The preferred alcohols are the ones listed for component B, especially pentaerythritol.

The acid portion of the ester dispersant is derived from a carboxylic acid-producing compound having a substantially saturated aliphatic hydrocarbon-based radical (as defined hereinabove) containing at least about 30 and preferably at least about 50 and up to about 400 aliphatic carbon atoms. By "carboxylic acid-producing compound" is meant an acid, anhydride, acid halide, ester or the like; the acids and anhydrides are preferred.

Any one of a number of known reactions may be employed for the preparation of the carboxylic acid-producing compound. Thus, an alcohol or the desired molecular weight may be oxidized with potassium permanganate, nitric acid or a similar oxidizing agent; a halogenated olefin polymer may be reacted with a ketene; an ester of an active hydrogen-containing acid, such as acetoacetic acid, may be converted to its sodium derivative and the sodium derivative reacted with a halogenated high molecular weight hydrocarbon such as brominated wax or brominated polyisobutene; a high molecular weight olefin may be ozonized; a methyl ketone of the desired molecular weight may be oxidized by means of the haloform reaction; an organometallic derivative of a halogenated hydrocarbon may be reacted with carbon dioxide; a halogenated hydrocarbon or olefin polymer may be converted to a nitrile, which is subsequently hydrolyzed; or a suitable hydrocarbon-based compound, usually an olefin polymer, may undergo an addition reaction with an unsaturated acid or anhydride, frequently in the presence of chlorine. The latter reaction is preferred and is more fully described hereinafter.

The hydrocarbon-based compound should be substantially saturated (as previously defined) and is usually free from pendant groups containing more than about six carbon atoms. The preferred hydrocarbon-based compounds are those derived from substantially saturated petroleum fractions and olefin polymers, particularly polymers of monoolefins having from 2 to about 30 carbon atoms. Thus, the hydrocarbon-based compound may be derived from a polymer of ethylene, propene, 1-butene, isobutene, 1-octene, 3-cyclohexyl-1-butene, 2-butene, 3-pentene or the like. Also useful are interpolymers of olefins such as those illustrated above with other polymerizable olefinic substances such as styrene, chloroprene, isoprene, p-methylstyrene, piperylene and the like. In general, these interpolymers should contain at least about 80%, preferably at least about 95%, on a weight basis of units derived from the aliphatic monoolefins.

Another suitable class of hydrocarbon-based compounds comprises saturated aliphatic hydrocarbons such as highly refined white oils or synthetic alkanes having at least about 30 carbon atoms.

In many instances, the hydrocarbon-based compound should contain an activating polar radical to facilitate its reaction with the unsaturated acid or derivative thereof. The preferred activating radicals are halogen atoms, especially chlorine, but other suitable racicals include sulfide, disulfide, nitro, mercaptan, ketone and aldehyde groups.

As already pointed out, the hydrocarbon-based compound generally contains at least about 30 and preferably at least about 50 carbon atoms. Among the olefin polymers those having a number average molecular weight (as determined by gel permeation chromatography) of about 700–5,000 are preferred, although higher polymers having molecular weights from about 10,000 to about 100,000 or higher may sometimes be used. Especially suitable are isobutene polymers within the prescribed molecular weight range, and chlorinated derivatives thereof.

The unsaturated acids or anhydrides suitable for reaction with the hydrocarbon-based compound are known in the art to be so suitable and include maleic acid, maleic anhydride, fumaric acid and acrylic acid. Maleic acid and maleic anhydride are preferred; the resulting product is then a hydrocarbon-substituted succinic acid or anhydride which may contain minor amounts (usually less than 1% by weight) of halogen or elements derived from the other activating polar radicals.

The reaction procedure is known and involves merely heating a mixture of the reactants at about 100°–200° C., usually 140°–200° C. The substituted acid or anhydride thus obtained, may, if desired, be converted to the corresponding acid halide by reaction with known halogenating agents such as phosphorus trichloride, phosphorus pentachloride or thionyl chloride.

The ester dispersant may be prepared by reacting the polyhydric alcohol with the carboxylic acid-producing compound at a temperature above about 100° C. and typically at 150°–300° C. The ester thus formed may be neutral or acidic, or may contain unesterified hydroxy groups, according as the ratio of equivalents of acid-producing compound (based on the number of carboxy groups therein) to hydroxy compound (based on the number of hydroxy groups therein) is equal to, greater than or less than 1:1.

Typical ester dispersants suitable for use as component C are listed in Table I.

TABLE I

| Example | Acid-producing compound | Alcohol | Ratio of equivalents, acid:alcohol | Reaction temperature, °C. | Diluent |
|---|---|---|---|---|---|
| 1 | Polyisobutenyl (mol.wt. about 1100) succinic anhydride prepared from chlorinated polyisobutene | Pentaerythritol | 0.5 | 150–210 | Mineral oil |
| 2 | Like Example 1, except polyisobutene mol. wt. is about 1000 | Neopentyl glycol | 1.0 | 240–250 | — |
| 3 | Same as Example 2 | Polyethylene glycol (mol. wt. about 600) | 2.0 | 240–250 | — |
| 4 | Reaction product of chlorinated (4.5% Cl) polyisobutene (mol. wt. about 982) with acrylic acid | Sorbitol | 0.48 | 115–205 | Mineral oil |
| 5 | Same as Example 4 | Pentaerythritol | 1.0 | 180–205 | — |
| 6 | Reaction product of polyisobutene (mol. wt. 1500) with chloroacetyl chloride | Mannitol | 0.33 | 115–205 | Mineral oil |

TABLE II

| Example | 7 | 8 | 9 | 10 | 11 | 12 | 13 | 14 | 15 |
|---|---|---|---|---|---|---|---|---|---|
| "Hercoflex 707A" mixed pentaerythritol and tripentaerythritol esters of predominantly straight-chain $C_{5-10}$ aliphatic carboxylic acids | — | — | 184.0 | 400.0 | — | — | — | 104.0 | — |
| "Hercolube F" dipentaerythritol ester of predominantly straight-chain $C_{5-10}$ aliphatic carboxylic acids | 208 | 104.0 | — | — | — | — | 104.0 | — | — |
| Tridecyl ester of $C_{5-18}$ alkenyl succinic acid | — | — | — | — | 104.0 | 208.0 | — | — | 207.9 |
| Product of Example 1 | 89.9 | 89.9 | 402.0 | 402.0 | 44.9 | 89.6 | 89.6 | 89.6 | — |
| Product of Example 5 | — | — | — | — | — | — | — | — | 89.8 |
| Reaction product of tetrapropene-alkylated phenol, formaldehyde and hydroxyalkyl amine | — | — | — | — | — | 5.3 | 5.3 | 5.3 | — |
| Ethoxylated reaction product of fatty acid-naphthenic acid mixture with polyethylene polyamine mixture | 3.1 | 3.1 | 13.8 | 13.8 | 1.5 | 3.0 | 3.0 | 3.0 | — |
| Polyisobutenyl succinic acid | — | — | — | — | — | 11.2 | 11.2 | 11.2 | — |
| Exxon proprietary demulsifier composition | 2.1 | 2.1 | 9.2 | 9.2 | 1.1 | 2.0 | 2.0 | 2.0 | 4.0 |
| Tretolite proprietary demulsifier composition | 2.1 | 2.1 | 9.2 | 9.2 | 1.1 | 2.0 | 2.0 | 2.0 | 2.0 |
| Nalco proprietary dehazer | 3.0 | 3.0 | 13.3 | 13.3 | 1.5 | 3.0 | 3.0 | 3.0 | 2.0 |
| Isooctyl alcohol | 31.0 | 31.0 | 138.7 | 138.7 | 15.5 | 41.9 | 41.9 | 41.9 | 48.8 |
| Xylene | 97.0 | 97.0 | 433.9 | 433.9 | 48.5 | 123.9 | 123.9 | 123.9 | 133.5 |

The compositions of this invention generally contain about 50–500 and preferably about 100–400 parts by weight of component B, and about 40–500 parts and preferably about 80–400 parts by weight of component C, per million parts of component A. The weight ratio of component B to component C is usually approximately between 1:10 and 10:1. In addition to component A, B and C, the compositions may contain other additives which are known to those skilled in the art, including anti-knock agents such as tetraalkyllead compounds, lead scavengers such as the haloalkanes, deposit preventers or modifiers such as the triaryl phosphates, dyes, anti-oxidants such as 2,6-di-t-butyl-4-methylphenol, rust inhibitors such as alkylated succinic acids, auxiliary dispersants such as amide or amide-imide dispersants or Mannich reaction products known in the art, demulsifiers, bacteriostatic agents, gum inhibitors, metal deactivators, upper cylinder lubricants, and the like.

SPECIFIC EMBODIMENTS

Typical fuel compositions of this invention are listed in Table II. In each instance the fuel is gasoline, and the concentration of the other ingredients are listed as parts by weight per million parts of fuel. All amounts, except those for xylene and isooctyl alcohol, are exclusive of diluents.

What is claimed is:

1. A fuel composition comprising:

a major amount of

A. a normally liquid fuel and, dissolved therein, the combination of:

B. about 50–500 parts by weight, per million parts of component A, of at least one ester selected from the group consisting of 1. esters of polyols containing at least 3 hydroxy groups and $C_{5-15}$ aliphatic monocarboxylic acids, and 2. esters, containing about 30–80 carbon atoms, of an alkanol and an alkyl-based succinic or alkenyl-based succinic acid; and C. about 80–400 parts, per million parts of component A, of at least one oil-soluble, nitrogen-free dispersant which is an ester of a polyhydric alcohol and a carboxylic acid which has within its molecular structure a substantially saturated aliphatic hydrocarbon-based radical containing at least about 30 carbon atoms.

2. A composition according to claim 1 wherein component B is a liquid ester of an alkyl succinic or alkenyl succinic acid in which the alkyl or alkenyl group contains about 10–20 carbon atoms and $C_{10-20}$ alkanol.

3. A composition according to claim 2 wherein component A is gasoline.

4. A composition according to claim 3 wherein the alkanol is tridecyl alcohol.

5. A composition according to claim 1 wherein component C is an ester of a succinic acid containing a hydrocarbon-based substituent having at least about 50 carbon atoms.

6. A composition according to claim 5 wherein component A is gasoline.

7. A composition according to claim 6 wherein component C is a pentaerythritol ester.

8. A composition according to claim 7 wherein the hydrocarbon-based substituent of component C is derived from an olefin polymer.

9. A composition according to claim 8 wherein the olefin polymer is polyisobutene.

* * * * *

UNITED STATES PATENT AND TRADEMARK OFFICE

CERTIFICATE OF CORRECTION

PATENT NO. : 4,032,303

DATED : June 28, 1977

INVENTOR(S) : Casper John Dorer, Jr. and Clark Ober Miller

It is certified that error appears in the above-identified patent and that said Letters Patent are hereby corrected as shown below:

Column 6, line 64, "selected from" should be cancelled; lines 65-68 should be cancelled entirely. Column 7, line 1, "2. esters," should be cancelled; line 14, after "and" insert --a--.

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*